US005485135A

United States Patent [19]

Hipp

[11] Patent Number: 5,485,135

[45] Date of Patent: Jan. 16, 1996

[54] IGNITION COIL ASSEMBLY FILLED WITH RESINOUS MATERIAL

[75] Inventor: Mark E. Hipp, South Lyon, Mich.

[73] Assignee: Ford Motor Company, Dearborn, Mich.

[21] Appl. No.: 369,564

[22] Filed: Jan. 6, 1995

Related U.S. Application Data

[63] Continuation of Ser. No. 112,730, Aug. 26, 1993, abandoned.

[51] Int. Cl.[6] ..... H01F 27/30

[52] U.S. Cl. ..... 336/96; 336/107; 336/198; 336/205

[58] Field of Search ..... 336/96, 205, 198, 336/208, 185, 107; 123/621, 634

[56] References Cited

U.S. PATENT DOCUMENTS

| | | | |
|---|---|---|---|
| 1,239,008 | 9/1917 | Henderson | 336/205 |
| 3,273,099 | 9/1966 | Minks | 336/205 |
| 3,377,602 | 4/1968 | Kruse . | |
| 3,396,356 | 8/1968 | Whipple | 336/205 |
| 3,559,134 | 1/1971 | Daley | 336/96 |
| 3,737,823 | 6/1973 | Mees et al. | 336/205 |
| 4,763,094 | 8/1988 | Kojima | 336/96 |
| 4,918,419 | 4/1990 | Ida . | |
| 4,985,984 | 1/1991 | Umezaki | 336/96 |
| 5,015,984 | 5/1991 | Vialaneix | 336/198 |
| 5,032,814 | 7/1991 | Badaud . | |

FOREIGN PATENT DOCUMENTS

| | | | |
|---|---|---|---|
| 0253939 | 1/1988 | European Pat. Off. . | |
| 0395513 | 10/1990 | European Pat. Off. . | |
| 3308685 | 9/1984 | Germany | 336/205 |

*Primary Examiner*—Thomas J. Kozma
*Attorney, Agent, or Firm*—Kevin G. Mierzwa; Roger L. May

[57] ABSTRACT

A secondary ignition coil is wound around a bobbin having a plurality of slots therein. The slots are spaced around the cylindrical wall of the bobbin to provide for the rapid and uniform flow of resinous potting material through the slots in the cylindrical wall into the coil. Resin also flows from the outer portion of the coil winding into said coil winding.

5 Claims, 2 Drawing Sheets

IGNITION COIL ASSEMBLY FILLED WITH RESINOUS MATERIAL

This is a continuation of application Ser. No. 08/112,730 filed Aug. 26, 1993, now abandoned.

BACKGROUND OF THE INVENTION

This invention relates generally to ignition coils, particularly for internal combustion engines, and vehicular ignition systems, and more specifically to a bobbin assembly of the ignition coil.

With the advent of the microprocessor and related sophisticated electronic controls, vehicular ignition systems and ignition system strategies have undergone a great many improvements. Some of the benefits now being derived through the incorporation of these new systems and strategies include improved spark timing, and improved reliability. One outcome, of a more efficient combustion process is that it allows for the extension of the percentage of exhaust gas recirculation. Improvements in emissions, power, and other performance characteristics result.

Changes in the ignition coil design have also been a part of this overall improvement. Use of the single ignition coil for each ignition device, i.e. spark plug, has provided the opportunity to more precisely control ignition characteristics within each combustion chamber. Some ignition systems for internal combustion engines use an ignition coil or coils having a C-shaped iron core within a non-conductive housing, with the primary and secondary windings wound on individual bobbins inter-nested within one another and lying within the boundaries of the C-shaped iron core. The coil is filled with epoxy potting material or other insulating material as a final step in the process. The epoxy material prevents the effects of torsional forces that the windings are subject to in operation. One effect of the torsional forces is that the insulation on the windings wears quickly.

One known method of filling the windings with epoxy is using a vacuum atmosphere around the windings and letting the epoxy impregnate from the outside of the coil to the inside of the coil. One drawback of such a method is that it may take many hours for the epoxy to penetrate into the coil windings. Another drawback is that if full penetration is not achieved the efficiency of the device decreases. There is in fact a delicate balancing of many factors to achieve perfect impregnation, namely the chemical reaction time of the epoxy, winding tension vacuum level, and processing temperatures. The ideal situation occurs when the windings impregnate uniformly in the least amount of time with the cured epoxy exhibiting the desired physical properties. Attempts have been made to reduce the impregnation time by varying certain constituents of the epoxy formulation as well as certain manufacturing processing parameters. However, none of these methods significantly reduced the impregnation time.

U.S. Pat. No. 3,377,602 describes another method of impregnating a coil with a resinous material. In that patent the resinous material is forced with positive pressure through a single circumferential groove in the interior of a two-piece pole portion upon which wire is wound. The patent teaches away from using a vacuum environment. The oils and moisture remaining in the windings will inhibit the distribution of resinous material resulting in an uneven distribution of material throughout the winding. This method of fastening the windings uses a felt member which also must become saturated in epoxy in order to hold the windings.

It would therefore be desirable to provide a method of impregnating coil windings with epoxy evenly through its entire cross section in a relatively short period of time.

SUMMARY OF THE INVENTION

A preferred embodiment includes a bobbin having an inner tubular wall portion of a given thickness with a plurality of slots spaced around and extending through the entire thickness of the bobbin portion. A plurality of wire windings are wound about the inner tubular wall portion. An epoxy agent is simultaneously impregnated into the winding from the outside of the winding to the inside and vice versa. The slots in the inner wall portion permit the epoxy to impregnate into the windings from the inner wall portion toward the outside of the winding.

DETAILED DESCRIPTION OF THE PREFERRED EMBODIMENT

Figure 1:
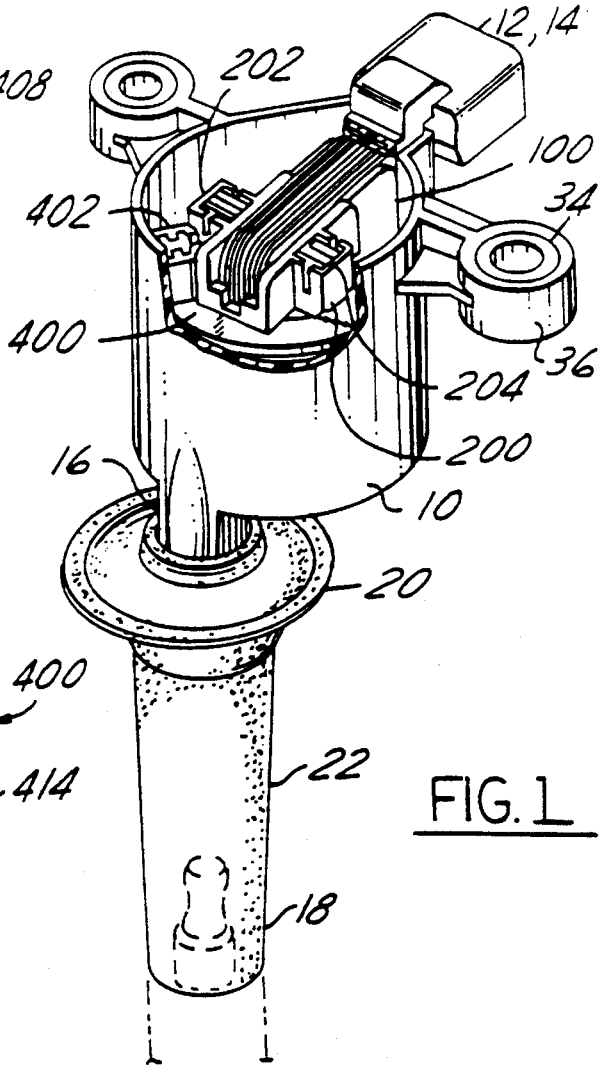
FIG. 1 is a general perspective view of an ignition coil assembly with potting material removed and the primary connector assembly in partial section.

In FIG. 1 is shown the overall assembly of the ignition coil assembly of the present invention. The ignition coil is a coil-per-plug type ignition coil assembly mounted upon and electrically connected to a typical ignition spark plug as shown in phantom. It includes a generally annular housing 10 within which is nested a steel laminated C-shaped core member 100 which provides an open cavity portion or air gap between its terminal ends, and with a primary and secondary bobbin assembly 200, 400 residing within the cavity portion between the terminal ends of the C-shaped core member 100. The primary coil member 200 includes a T-shaped steel laminated core member (not shown) extending axially through the primary bobbin.

The primary bobbin includes a pair of primary terminal receptacles 202, 204 within which are located solderless, spring-retained, insulation displacement terminals.

A primary connector assembly 12, partially shown, is adapted to clip onto the housing and includes leads in a receptacle portion 14 which establishes electrical connection across the primary and secondary coils.

The secondary bobbin 400 includes an input terminal 402 and a corresponding secondary bobbin output terminal (not shown in FIG. 1) which is located at the lower end of the secondary bobbin within the area of the terminal stem portion 16 of the housing. Slip-fit over the terminal stem portion 16 is a flexible rubber boot 18 having a collar 20 which grips the stem portion 16 and a barrel portion 22 adapted to grip and establish electrical connection with a spark plug head in a manner described below.

Figure 2:
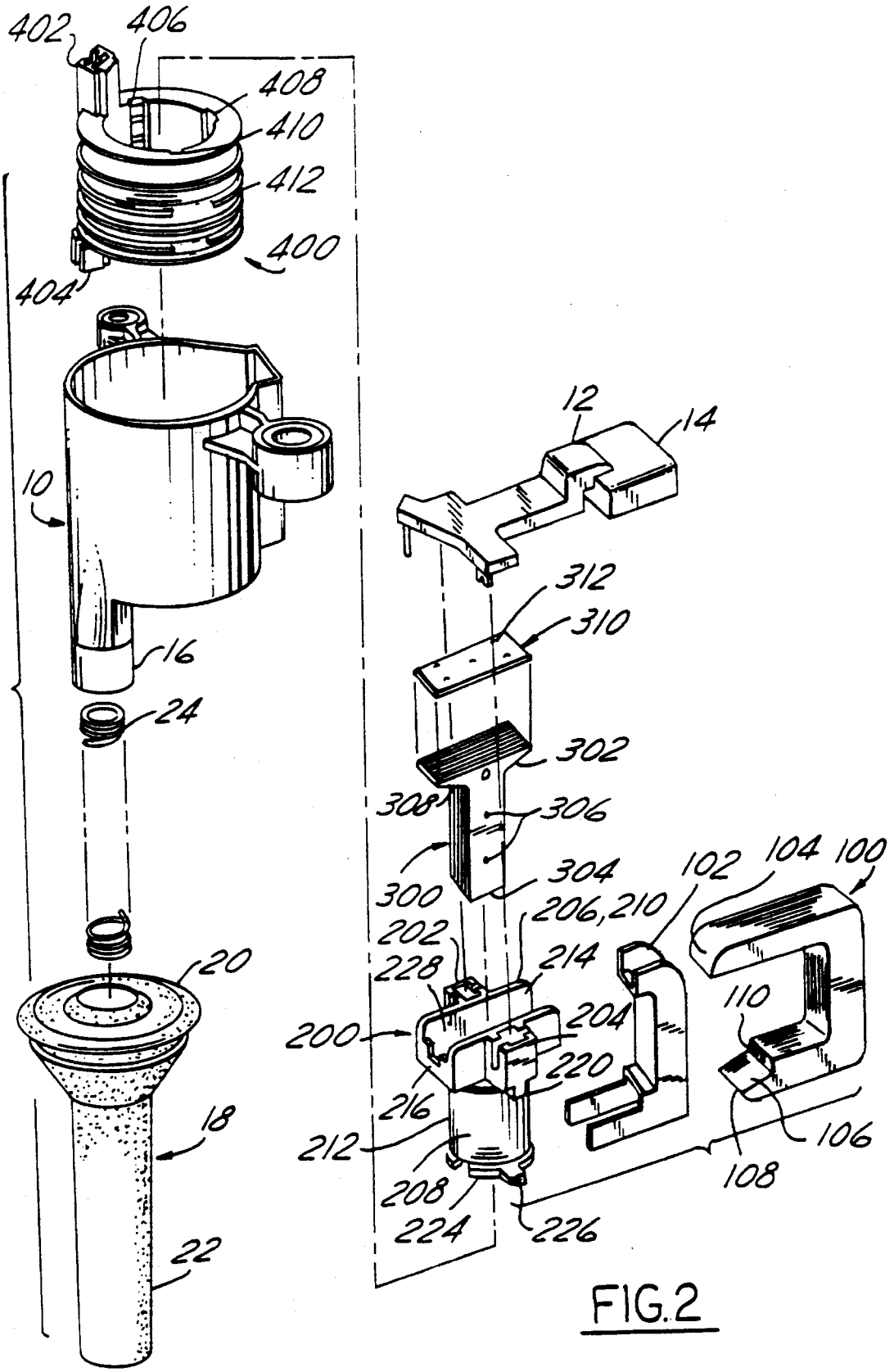
FIG. 2 is a perspective, exploded view of the ignition coil assembly shown in FIG. 1.

Referring now to FIG. 2, the primary bobbin sub-assembly 200 includes a primary bobbin 206 having a primary coil 208 wound around the longitudinal axis thereof. The bobbin 206 includes an upper channel-shaped head portion 210 and a lower annular portion 212. The bobbin includes a rectangularly shaped bore 228 extending along the longitudinal axis thereof from one end to the other and sized to receive, in sliding fit, the T-shaped steel laminated core member 300. The upper channel section of the bobbin includes a pair of spaced side walls 214 and a stop wall 216 at one end thereof, extending between the side walls. The upper channel section includes three locating lugs 218, 220, 222, (218 and 222 not shown in this view). Two of these (218, 220) are located at the bottom of the respective terminal receptacles 202, 204. At the bottom of the primary bobbin is located an annular collar 224 and radially projecting from the collar is a pair of similar locating lugs 226 axially aligned with those extending from the terminal portions 202, 204 of the upper portion of the bobbin.

The T-shaped core member 300 which is slidingly received within the primary bobbin assembly 200 includes a cross-bar member 308 having tapered under sides 302 at one end and a tapered end or ramp 304 at its other end. The T-shaped core member is a series of steel laminations secured together by punched or stamped stakes 306.

Magnetically attached to the cross-bar portion 308 is a plate-like permanent magnet 310. It includes a plurality of protrusions 312 on,its upper surface. The height or length of each equally or slightly exceeding the maximum differential in stack-up tolerances governing the filling of the distance between the terminal ends of the C-shaped core member by the T-shaped core member and permanent magnet. The magnet member is made of a bonded magnetic material which is substantially less than fully dense. It is made of grains of rare earth, high energy materials such as neodymium and samarium evenly dispersed within a binder, such as a plastic or epoxy matrix. In our preferred example, neodymium grains are dispersed within a nylon matrix such that the resulting composite material has a flux density of 4.2 kilogauss, whereas a fully dense magnet would have a flux density of 12 kilogauss.

The primary coil bobbin assembly 200 is adapted to be received within the cylindrical secondary coil bobbin assembly 400. The secondary coil bobbin assembly 400 includes integral secondary terminal portions 402 and 404. Within the end of each terminal portion is located a similar solderless spring-retained insulation terminal. Located about the inner cylindrical surface of the secondary bobbin 400 are three longitudinally extending slots 406, 408, 410. Each slot is formed as an opening through the cylindrical surface. A portion of the coil winding 412 which is wound about the outer periphery of the secondary coil bobbin member 400 is exposed to the interior of the cylindrical secondary bobbin. Coil winding 412 is connected about its respective ends to input and output secondary terminal portions 402, 404. Slots 406, 408, 410 are sized to receive locating lugs 218, 220, 222 respectively of the primary bobbin assembly. Thus, when the primary bobbin is inserted within the secondary bobbin, it is uniquely positioned within the secondary bobbin by keying the circumferential location of each locating lug. Also, the relative longitudinal location is fixed by virtue of the tapered undersides of the upper channel portion of the bobbin coming to rest on the edge or lip of the secondary bobbin. Further, the slots 406, 410 on the secondary bobbin have tabs 418 on the underside of the bobbin. As the upper channel portion of the primary bobbin comes to rest on the lip of the secondary bobbin, the protrusions 232 on the locating lugs 226 engage the tabs 418, thus snapping the primary bobbin in place.

The plastic insulating clip member 102, made of modified polypropylene with 10% filler, or other suitable material, is slidably engaged within the open cavity of the C-shaped core member 100. The clip is sized such that the side walls thereof firmly grip the outer walls of the C-shaped core member, as shown and described below. Its intervention between the bobbin and core mitigates any effect of thermal expansion of the core.

The C-shaped core member 100 with clip 102, is inserted from its open end within the channel-shaped upper head portion of the primary bobbin such that the upper terminal end 104 of the C-shaped core member will come to rest against the stop wall 216 of the primary bobbin. At the same time, the ramp or inclined end portion 304 of the T-shaped core member within the primary bobbin assembly will engage in line-to-line contact along the corresponding ramp end portion 106 of the C-shaped core member at its other terminal end 108. The assembly continues until the T-shaped core member abuts the stop shoulder 110 of the C-shaped core member. Further, the degree of lift designed into the inclined ramp, is also designed to force the T-shaped core member 300 and permanent magnet 310 into full contact with the other terminal end portion of the C-shaped core member 100, thus virtually eliminating any air gap which might otherwise exist between the C-shaped core member and the T-shaped core member.

By virtue of the protrusions 312 extending from the permanent magnet, some degree of physical contact between the permanent magnet and T-shaped core member on the one hand and the end 104 of the C-shaped core member is always guaranteed. This in turn assures that there will always exist at the other end line contact across the interengaging ramp surfaces 304, 106 of the core members 300, 100, respectively.

The core and primary and secondary bobbin subassembly is slidably engaged within the housing 10. Thereafter, the boot assembly including the retainer spring 24 is slip-fit onto the one end of the housing and the primary connector assembly 12 is clipped onto the opposite end of the housing. This completes the core assembly, as shown in FIGS. 1 and 2.

Figure 4:
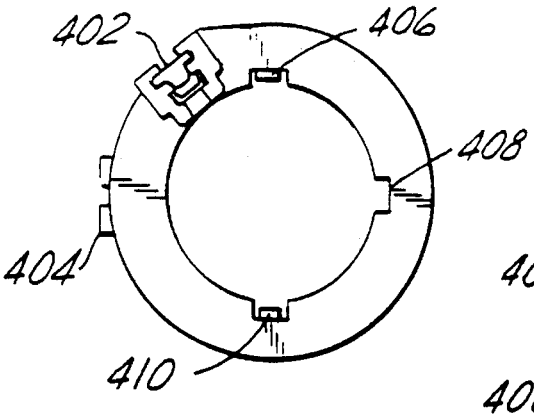
FIG. 4 is a plan view of the secondary bobbin and winding assembly shown in FIG. 3 as viewed from the upper end thereof.
Figure 3:
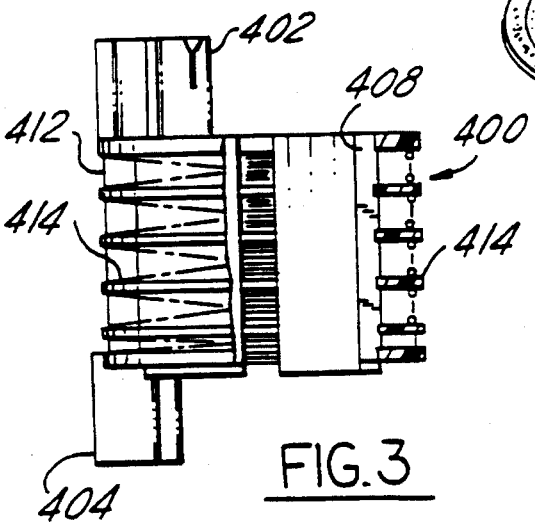
FIG. 3 is an elevation view of the secondary bobbin and winding assembly.
Figure 5:
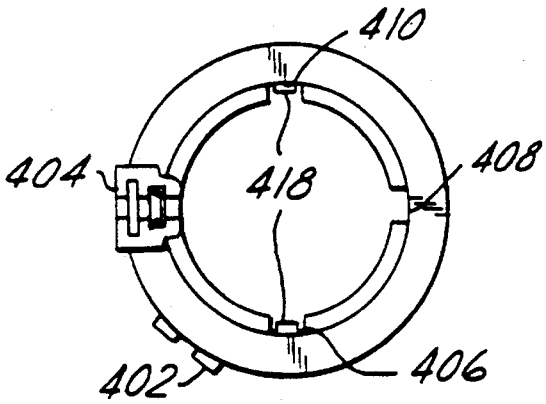
FIG. 5 is a plan view of the secondary bobbin and winding assembly shown in FIG. 3 as viewed from the bottom thereof.

Looking at FIGS. 3–5, there is shown the details of the secondary bobbin 400 and winding assembly. Like the primary coil bobbin, the secondary coil bobbin is an integral injection molded plastic member, preferably made of nylon or similar material. It is generally cylindrical or tubular, with its inner dimensions being sized to closely receive the primary bobbin assembly and including a plurality of elongated slots 406, 408, 410. Slots 406, 408, 410 form openings extending completely through the side wall of the bobbin. Slots 406, 408, 410 can extend longitudinally through the length of the bobbin 400. The input and output terminal portions 402, 404 are located at respective ends of the bobbin. The bobbin includes a plurality of annular ribs 414 forming segmented bays for maintaining the location of the coil wire as it is wound annularly over the bobbin. The slots 406, 408, 410 are adapted to receive the locating lugs 218, 220, 222, respectively, of the primary bobbin assembly as earlier explained.

After assembly of all components, the ignition coil assembly is placed in a vacuum environment. The coils are heated to 120° C. from between 2–2.5 hours to purge any moisture, air and oil trapped in the winding. Contaminants such as moisture or oil can inhibit the impregnation of potting material into the windings. While still in the vacuum environment the ignition coil assembly is filled with the potting material. The vacuum prevents any contaminants or air from reentering the coil.

The potting material flows into the secondary winding 412 from two directions; from the outside of the secondary coil bobbin 400 into winding 412 and from the inside of the secondary coil bobbin 400 toward the outside of the winding 412. The elongated slots provide a route for the potting material to flow from the inner portion of the secondary bobbin assembly. As the assembly is filled with potting material, the potting material flows radially toward the center and radially from the center outward so that the spacings between the individual wires of the secondary winding 412 become filled with potting material in order to better hold the winding together. The potting material can be a resinous material such as epoxy. The impregnation of the windings using this method is so uniform that no additional bond means (i.e., felt) is necessary between the winding and the bobbin to facilitate impregnation. This method of filling the secondary winding 412 with potting material achieves a much more uniform distribution of the epoxy and constituents of the epoxy (e.g., fillers) within as well as around the outer surfaces of the windings in a significantly reduced amount of time without varying the viscosity or the temperature of the existing process. With this new process penetration time was reduced to about 8 hours.

The slot size, slot location and various other aspects of the above described invention can be varied without deviating from the true scope of the invention. These variations would be apparent to one skilled in the art.

What is claimed is:

1. An ignition coil assembly comprising:

a primary winding assembly having at least one locating lug;

a secondary winding assembly including;

a bobbin having a tubular wall having defined therein a plurality of longitudinally extending slots spaced around and extending through the entire thickness of said tubular wall portion, said slots formed to receive said locating lug of said primary winding within said secondary winding, said bobbin having an inner portion and an outer portion delineated by said tubular wall;

a plurality of coil windings juxtaposed to said slots wound on the outer portion of said tubular wall portion; and a potting material filling said secondary winding, said slots in said inner wall portion permitting said potting material to impregnate into said secondary winding through said tubular wall.

2. The ignition coil assembly of claim 1 wherein said number of locating lugs corresponds to the number of slots.

3. The ignition coil assembly of claim 1 wherein said slots are formed to uniquely locate said primary winding within said secondary winding.

4. A coil assembly comprising:

a primary winding assembly having at least one locating lug;

a secondary winding assembly including;

a bobbin having a tubular wall of a given thickness delineated an outer portion and an inner portion, said outer surface of said outer portion of said bobbin comprises a plurality of walls extending axially forming segmented bays, said bobbin having a plurality of locating slots extending longitudinally across the entire length of said bobbin, said locating slots spaced around and extending through said thickness of said tubular wall; and a plurality of coil windings wound around said outer portion of said tubular wall juxtaposed to said locating slots, said locating slots located for permitting a potting material to impregnate radially from said inner portion of said bobbin and to locate said locating lug of said primary winding upon the insertion of said primary winding within said secondary winding, whereby a uniform distribution of said potting material is formed in said coil windings in conjunction with the flow of potting material from the outer portion of said bobbin.

5. The coil assembly of claim 4 further comprising potting material uniformly distributed within said coil windings for providing rigid support therefor.

* * * * *